United States Patent [19]

Lenôtre

[11] 4,016,018

[45] Apr. 5, 1977

[54] METHOD OF PREPARING PRIMING EXPLOSIVES

[75] Inventor: Michel Pierre Alphonse Lenôtre, Tarbes, France

[73] Assignee: Etat Francais, Paris, France

[22] Filed: Aug. 13, 1973

[21] Appl. No.: 387,812

Related U.S. Application Data

[63] Continuation-in-part of Ser. No. 100,428, Dec. 21, 1970, abandoned.

[30] Foreign Application Priority Data

Dec. 22, 1969 France ..... 69.44313

[52] U.S. Cl. ..... 149/17; 149/19.1; 149/19.5; 149/19.91; 149/19.93; 149/20; 149/35

[51] Int. Cl.² ..... C06B 45/04; C06B 45/10; C06B 45/08; C06B 35/00

[58] Field of Search ..... 149/14, 15, 16, 17, 149/19.1, 19.5, 19.91, 19.92, 19.93, 20, 35; 102/28 R

[56] References Cited

UNITED STATES PATENTS

| | | | |
|---|---|---|---|
| 2,995,086 | 8/1961 | Scott | 149/15 |
| 3,173,817 | 3/1965 | Wright | 149/19.93 |
| 3,278,350 | 10/1966 | Caldwell | 149/7 |
| 3,325,317 | 6/1967 | Voigt | 149/19 |
| 3,354,010 | 11/1967 | Hopper | 149/18 |
| 3,549,436 | 12/1970 | La Rocca | 149/15 |
| 3,586,551 | 6/1971 | Nolan | 149/2 |

FOREIGN PATENTS OR APPLICATIONS

| | | |
|---|---|---|
| 439,680 | 1968 | Japan |

*Primary Examiner*—Samuel W. Engle
*Assistant Examiner*—Donald P. Walsh

[57] ABSTRACT

A priming explosive is produced by mixing an aqueous solution of a finely divided explosive substance such as in colloidal form with a plastic polymeric carrier and a plasticizer whereby the explosive substance is rendered mechanically workable and has little sensitivity to mechanical shock and electrical impulses. The resulting plastic product is then molded by conventional molding techniques into sheets or films and used as a primer, optionally, by itself without any metal parts. The molded product may be applied to a main explosive mass as a coating or as a strip or it can be formed as a condensor of alternating conductive and insulative layers which is detonated by electrical impulse.

8 Claims, 1 Drawing Figure

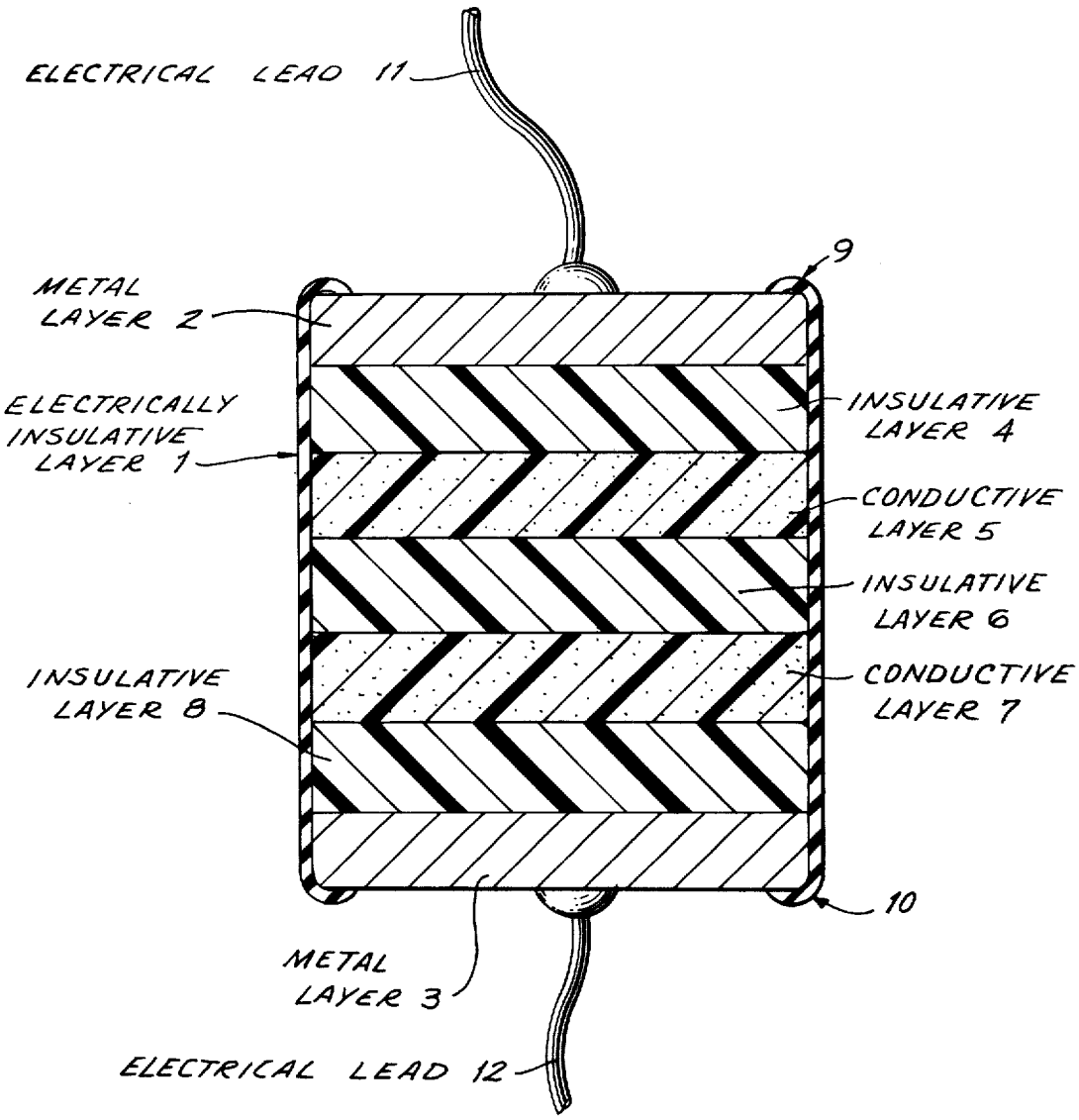
ELECTRICAL LEAD 11
9
METAL LAYER 2
ELECTRICALLY INSULATIVE LAYER 1
INSULATIVE LAYER 4
CONDUCTIVE LAYER 5
INSULATIVE LAYER 6
CONDUCTIVE LAYER 7
INSULATIVE LAYER 8
10
METAL LAYER 3
ELECTRICAL LEAD 12

METHOD OF PREPARING PRIMING EXPLOSIVES

CROSS-RELATED APPLICATION

This application is a continuation-in-part of co-pending application Ser. No. 100,428, filed Dec. 21, 1970, now abandoned and claims the priority of the application filed in France on Dec. 22, 1969.

BRIEF DESCRIPTION OF THE DRAWING

The sole FIGURE of the drawing is a diagrammatic sectional view on enlarged scale, of a condenser according to the invention which can be detonated by electrical impulse and serve as a primer.

DETAILED DESCRIPTION

The invention relates to the production of priming explosives utilizing known explosive substances.

The known priming explosives suitable for use in pyrotechnical compositions (primers or detonators operated electrically or not) are employed either in the pure state or in a mixture with other constituents in the form of crystallized or powdery chemical products. Their handling relies on the techniques for handling powders and therefore involves a certain number of disadvantages namely: dangerous explosive dust is formed, no great variation is possible in the geometric form of the explosive devices, the explosive may not be uniformly mixed in the mass of the explosive mixtures.

In order to avoid these disadvantages, it is known either a. to utilize products modifying the crystalline faces of the primary explosives, (introduction in the course of the preparation of the explosive of inert material such as polyvinyl alcohol, carboxymethyl cellulose or dextrine, etc.) for reducing the sensitivity of the friction of the primary powder explosives, or b. to utilize elastomers limited to the obtention of films or flexible sheets of lead azide.

The present invention is directed to novel methods for the preparation and treatment of priming explosives either pure or mixed by which the abovementioned drawbacks are obviated while preserving their essential features.

The invention contemplates the formation of priming explosives in a new presentation, i.e. mechanically workable plastic product. The production of these chemicals in a new presentation allows the explosive substance to have momentarily little sensitivity to mechanical shock and electrical impulses and moreover permits a simpler treatment associated with the technology of plastics (kneading, calendering, extrusion, molding) and even of paints and varnishes (brush, spray gun).

According to the present invention, the priming explosive and the other ingredients intended to be mixed with it, such as oxidants, reducers, fine electrically conducting powders (graphite or metallic powders) are in extremely divided, or even colloidal form of a grain size less than 5 microns.

Such chemicals are never handled in the dry state but are always in a moist state or in aqueous suspension. They are present therefore in optimum conditions for intimate mixing with plastic materials in aqueous or dilute alcoholic suspension. According to the invention the plastic materials are selected from those which enable obtaining products which are moldable or extrudable cold or hot. The constituents are mixed by mechanical stirring which is especially energetic. The percentage of active end product varies from 80 to about 96% according to the method of production and the characteristics required. According to the invention, mixing and pre-polymerization are effected simultaneously in a reactor at a temperature between the ambient temperature and 80° C.

When the operation is completed, the two phases, liquid and solid, are separated by filtration and after mechanical working, final polymerization is achieved by a thermal action at a temperature dependent on the nature of the explosive and of the plastic, explosive mass, etc.

According to the invention, the primary explosives, the pyrotechnical compositions, either electrically conductive or not, and encased in a thermosetting or thermoplastic non-elastomer material permit the formation of thin plates of molded or calendered products, or of films of diverse shape and size possessing a better resistance to humidity and a greater mechanical strength than pyrotechnical powders normally compressed in the dry state.

The invention is described with reference to several Examples given by way of non-limitative illustrations. These relate to pure lead azide, a primary explosive particularly sensitive to friction, which is rendered practically insensitive to mechanical and electrical action by the processes of the invention throughout the entire working thereof to such an extent that it is even less sensitive than secondary explosives. When the preparation is ended, the explosive recovers a sensitivity that can be modified according to the characteristics of usage.

As required by the invention, a highly refined lead azide must be available of great purity (higher than or equal to 98%) without agglomerates, the average size of its grain being of the order of a few microns.

EXAMPLE 1

In this example, it is desired to obtain a hot-molding lead azide, and for this purpose a phenolic resin (phenoplast) soluble in ethyl alcohol is utilized.

Into a reactor are introduced 300 ml water, 10 g "fine" lead azide, 5 ml Bakelite A 77 (phenolic resin) solution at 10–30% strength in ethyl alcohol and 0.2–0.5 g plasticizer such as dibutyl phosphate. If the resulting composition is to have electrical conductivity, 0.5 g of graphite in pulverulent form is added to the mixture. Vigorous stirring is effected by means of a bicone type mixer at approximately 2,000 r.p.m. Stirring is continued for approximately 30 minutes at ambient temperature, then the mixture is filtered and washed. According to required performance figures, the amounts of reactants used can be modified.

EXAMPLE 2

If a cold-molding or cold-extrusion lead azide is desired, a polyester resin is employed by which polymerization takes place after the compression operation.

Into a reactor are introduced 300 ml water, 10 g lead azide, 0.5–1.5 g of a polyester of methacrylate or styrene base such as Rhodester 1108 (a polyester resin with an unsaturated styrene base) to which 0.2–0.5 g of a solution of 10 g polystyrene in 20 g monomeric styrene has been added. According to the characteristics required, there is finally added 0.2–0.6 g of a plasticizer such as dibutyl phthalate. As in Example 1, 0.5 g of pulverulent graphite can be added to obtain a product which is electrically conductive. Stirring of the mixture is effected vigorously for about 30 minutes at ambient temperature after which the mixture is filtered and washed. According to the nature and characteristics of the polyester, a hot prepolymerization may be obtained at a temperature of about 50°–60°C.

Another variant giving quite good results consists in using a polyamide resin soluble in a dilute alcoholic medium of a 6/10 type plasticized by paratoluensulfonamide.

EXAMPLE 3

If a puttylike mastic is desired, the lead azide can be mixed with a copolymer of vinyl chloride, vinyl acetate and heavily plasticized maleic acid in the following manner.

2.5–3 g fine lead azide are mixed with 0.2–1 g of a solution containing 30 g Rhodopas AXCM (a copolymer of vinyl acetate, vinyl chloride and modified by maleic acid) dissolved in 100 ml methyl ethyl ketone and 4 g of dibutyl phthalate as a plasticizer. Mixing is effected in an excess of solvent.

EXAMPLE 4

In addition to the Examples already given, which illustrate processes and products based on primary explosive, another form of the invention consists in obtainin an explosive obtaining or coating which can be applied by brushing or even sprayed without danger if the work is done carefully. The product is obtained as follows:

10 g lead azide is mixed with 5 g of a water-emulsionable polyester such as Rodester 3006 (an aqueous emulsion of unsaturated polyester type with a base of allyl phthalate) at 10% concentration and 5 g of a 10% polyvinyl alcohol solution in water, such as Phodoviol, and 1 g glycerin. A liquid is obtained whose viscosity can be altered according to requirements and the concentration of the lead. Thixotropic agents or metal powders can be added to produce an electrically conductive layer. Polymerization and setting are effected, as for a varnish, by heating the product in a vessel or by infrared radiation.

In Examples 3 and 4, it is possible to render the product electrically conductive by the addition of 0.5 g of pulverized graphite as in Examples 1 and 2.

Thus, according to the products employed and the working method followed, starting with a very finely divided or even colloidal primary explosive, a coating, paste or even a powder is obtainable that is only slightly sensitive to mechanical shock or electrical impulses and whose mechanical working can then be effected by conventional techniques of kneading, extrusion, and molding such as those employed in the production of paints and varnishes. It is permissible to add to the product suitable substances capable of modifying certain electrical or mechanical or even pyrotechnical properties by the addition of powdered metals, graphite, oxidizers or reducers.

The present invention is particularly directed to the use of the products for the production of new initiators and primers either on the basis of the material being mechanically worked or its configuration which allows the obtention of pyrotechnical characteristics that cannot normally be realized when following the standard means of charging.

The capability of being able to mold and/or extrude primary explosives, which has never previously been achieved with this family of explosives, provides the following advantages:

a. the obtention of pyrotechnical devices in irregular monolithic forms normally impossible of achievement when only the conventional utilization of powders is employed. Heretofore, a secondary explosive was excited by means of one or more initiators, so that the excitation of such secondary explosive could only be discontinuous in space and time. The use of an explosive coating or an explosive strip as by the present invention, allows considerable improvement over the known priming devices while at the same time simplifying the assembly and making the excitation of the secondary explosive practically uniform in space and time.

Additionally, it now becomes possible according to the invention to realize easily what was not attainable until now, of electro-explosive priming devices constituted as of "explosive condensers," in the form of sheets or other configurations made up of a stack of electrically insulating explosive layers and alternating explosive conductive layers.

The sole FIGURE of the attached drawing represents an embodiment of a condenser, according to the invention. In the drawing, there can be seen an evelope 1 of electrically insulative material, and two metallic electrodes 2 and 3 mounted at the two extremities of a stack of alternating insulative explosive layers 4, 6, 8 and conducting explosive layers 5 and 7. The extremities of the envelope 1 are crimped as shown at 9 and 10 to assure a good mechanical assembly of the entire arrangement. The electrical leads 11 and 12 connected to the electrodes 2 and 3 constitute the terminals of the condenser.

The number and the stacking of the explosive layers can be obtained in different ways such as:

by successive deposit of explosive paints forming alternative conducting and insulating layers, by the manufacture of thin, molded explosive plates, which are insulative and of thin molded explosive plates which are conductive and then juxtaposing the insulative and conductive plates in alternation, by the formation of thin plates by extrusion or calendering and cutting the plates in the form of bands. According to a non-limitating example, the following characteristics for a condenser, such as that illustrated in the drawing, have been obtained:

insulative layers: constant dielectric of 6 Kilovolts/cm. With layers of a thickness 0.2mm there is obtained a capacitance of 50 picofarads, conductive layers: resistivity 1000Ω per meter for layers containing 5% graphite, and a resistivity of 130Ω per meter for layers containing 3% graphite. The condenser can find all types of uses, for example, as an electrical detonater which is detonated by electrical impulse. It can assure a detonation at a distance from electrical or electronic elements of a control circuit and avoid the use of annexed destructive arrangements.

b. the production of highly combustible pyrotechnical devices (initiators) without any metallic parts, even in the case of electrical detonators or primers.

c. to reduce thermal sensitivity of the explosive devices obtained, particularly with the plasticized lead azide which has a thermal resistance higher by several tens of degrees with respect to pure lead azide or lead azide combined with carboxymethyl cellulose. Examination by means of a differential thermal analysis apparatus systematically shows a decomposition temperature superior to current industrial products. Certain plastics can be employed additionally functioning as a decomposition inhibitor with great efficiency as a consequence of close contact with the products.

d. the manufacturing process arising from the operation, consists in being able easily to automate production, the consequence of which is to make the same much more homogeneous.

In the case of a condensor of the type given hereinabove in (a) the conditions for detonation can vary within a large range of electrical energy i.e. between several microjoules to several tens of joules. Detonation can be effected by the use of alternating current and as will be apparent to those skilled in the electrical art, the conditions vary in accordance with such factors as the time constant of the electrical circuit, the voltage frequency, the available electrical energy, and the time of application i.e. waveform shape. In the case of direct current, a voltage of 200 volts will produce the pyrotechnical operation of a condensor having a dielectric layer of 0.2 mm with a surface area of 1 $cm^2$. The above values are intended merely to be exemplary to show that the condensors of the invention can be employed as conventional electrical circuit elements the conditions of whose operability can be determined.

What is claimed is:

1. A method for the preparation of explosive priming compositions which are water-resistent comprising the following steps: forming an aqueous dispersion of (a) lead azide as a primary explosive having a particle size less than 5 microns (b) a polymerizable plastic material which is non-elastomeric and insoluble in water and is selected from the group consisting of a phenolic resin, a polyester, a polyamide, and vinyl copolymers, and (c) a plasticizer; said aqueous dispersion rendering the primary explosive substantially explosively insensitive to mechanical and electrical action; mechanically and vigorously agitating the aqueous dispersion; separating, by filtration, a liquid phase from a solid phase; mechanically working the material of the solid phase; and effecting final polymerization thereof whereby a final product is obtained in which the primary explosive regains its explosive sensitivity.

2. A method according to claim 1 in which the plastic material is a phenolic resin soluble in ethanol, the mechanical working including as a final step a hot molding operation.

3. A method according to claim 1 in which the plastic material is a polyester resin, the plasticizer is dibutylphthalate, the mechanical working including as a final step cold molding, extrusion or calendering.

4. A method according to claim 1 in which the plastic material is a polyamide soluble in a dilute alcohol medium, the plasticizer is paratoluene sulfonamide, the mechanical working including as a final step cold molding, or cold extrusion.

5. A method according to claim 1 for obtaining a paste or mastic in which the plastic material is a mixture of a copolymer of vinyl chloride or vinyl acetate with plasticized maleic acid.

6. A method according to claim 1 for obtaining explosive points or films in which the plastic material is a water emulsion of a polyester.

7. A method according to claim 1 for obtaining electrically conductive compositions in which the primary explosive includes conductive particles mixed therewith before introduction into the dispersion.

8. A method according to claim 1 for obtaining electrically conductive compositions in which the primary explosive incudes conductive particles are introduced into the aqueous dispersion at the time of formation thereof.

* * * * *